US010309706B2

(12) United States Patent
Dirnberger et al.

(10) Patent No.: US 10,309,706 B2
(45) Date of Patent: Jun. 4, 2019

(54) COOLING OR FREEZING DEVICE HAVING AN ICE MAKER WITH A TEMPERATURE SENSOR

(71) Applicant: emz-Hanauer GmbH & Co., KGaA, Nabburg (DE)

(72) Inventors: Albert Dirnberger, Neunburg vorm Wald (DE); Roland Schroedel, Reichenschwand (DE); Manfredi Signorino, Wackersdorf (DE); Josef Bauriedl, Neunburg vorm Wald (DE); Thomas Baierl, Nabburg (DE); Michael Koch, Schmidgaden (DE)

(73) Assignee: emz-Hanauer GmbH & Co. KGaA, Nabburg (DE)

( * ) Notice: Subject to any disclaimer, the term of this patent is extended or adjusted under 35 U.S.C. 154(b) by 0 days.

(21) Appl. No.: 15/669,165

(22) Filed: Aug. 4, 2017

(65) Prior Publication Data

US 2018/0045448 A1 Feb. 15, 2018

(30) Foreign Application Priority Data

Aug. 10, 2016 (DE) ..... 10 2016 009 710

(51) Int. Cl.
*F25C 1/22* (2018.01)
*F25C 5/06* (2006.01)
(Continued)

(52) U.S. Cl.
CPC ..... *F25C 1/22* (2013.01); *F25C 5/06* (2013.01); *F25D 17/065* (2013.01);
(Continued)

(58) Field of Classification Search
CPC .. F25C 1/22; F25C 5/06; F25C 17/065; F25C 2400/10; F25C 2600/04; F25C 2700/12;
(Continued)

(56) References Cited

U.S. PATENT DOCUMENTS 3,937,032 A * 2/1976 Bright ..... F16D 43/25 62/135
4,142,373 A * 3/1979 Weibel, Jr. ..... F25C 1/04 62/138

(Continued)

FOREIGN PATENT DOCUMENTS

JP 2004-309046 A 11/2004

OTHER PUBLICATIONS

German Search Report in co-pendiing German Appl. No. 10 2016 009 710.8 dated Mar. 16, 2017.

*Primary Examiner* — Jonathan Bradford
(74) *Attorney, Agent, or Firm* — Robert R. Deleault, Esq.; Mesmer & Deleault, PLLC

(57) ABSTRACT

A cooling or freezing device includes an ice-making tray having a plurality of ice-piece-producing cavities distributed over at least two rows of cavities running parallel to one another. The device further includes a cold air supply system which provides a cold air stream which flows beneath the ice-making tray along the rows of cavities. There is additionally provided a temperature sensor unit which is inserted into a gap formed on the underside of the tray between a pair of adjacent ice-piece-producing cavities. The pair of cavities is formed by two ice-piece-producing cavities which, as seen in the direction of flow of the cold air stream, are the last ice-piece-producing cavities of two adjacent rows of cavities.

3 Claims, 3 Drawing Sheets

(51) Int. Cl.
*F25D 17/06* (2006.01)
*F25D 29/00* (2006.01)

(52) U.S. Cl.
CPC ..... *F25C 2400/10* (2013.01); *F25C 2600/04* (2013.01); *F25C 2700/12* (2013.01); *F25D 29/005* (2013.01); *F25D 2317/061* (2013.01); *F25D 2317/063* (2013.01)

(58) Field of Classification Search
CPC ..... F25D 29/005; F25D 2317/061; F25D 2317/063
See application file for complete search history.

(56) References Cited

U.S. PATENT DOCUMENTS

| | | | | | |
|---|---|---|---|---|---|
| 4,142,377 | A * | 3/1979 | Fogt | F25C 1/04 | 62/135 |
| 4,142,378 | A * | 3/1979 | Bright | F25C 1/04 | 62/135 |
| 4,628,699 | A * | 12/1986 | Mawby | F25C 1/04 | 62/137 |
| 4,680,943 | A * | 7/1987 | Mawby | F25C 1/04 | 211/153 |
| 5,182,916 | A * | 2/1993 | Oike | F25C 1/04 | 62/135 |
| 6,148,620 | A * | 11/2000 | Kumagai | F25C 1/04 | 62/135 |
| 2006/0137382 | A1 * | 6/2006 | Sasaki | F25C 1/04 | 62/340 |
| 2007/0089441 | A1 * | 4/2007 | Ito | F25C 1/22 | 62/135 |
| 2008/0034780 | A1 | 2/2008 | Lim et al. | | |
| 2015/0276295 | A1 * | 10/2015 | Barrena | F25C 1/04 | 62/135 |

* cited by examiner

COOLING OR FREEZING DEVICE HAVING AN ICE MAKER WITH A TEMPERATURE SENSOR

BACKGROUND OF THE INVENTION

1. Field of the Invention

The present invention relates generally to a cooling or freezing device which is equipped with an ice maker.

2. Description of the Prior Art

In many households of private individuals there are nowadays refrigerators or freezing devices which contain an ice maker for producing ice pieces. Some of these devices have, for example on the front of a device door, a delivery mechanism via which the ice pieces produced by means of the ice maker can be delivered in a metered manner.

An important criterion in the case of ice makers is the ice production rate, that is to say the quantity of ice pieces (e.g. expressed in the measuring unit kilograms) that can be produced per given unit time. The greater the ice production rate, the greater the usefulness for a private household, especially on hot summer days. There is therefore the general desire in the case of ice makers for as high an ice production rate as possible.

In order to determine when the water introduced into an ice-making tray has frozen and the finished ice pieces can accordingly be ejected from the ice-making tray, conventional ice makers are usually equipped with a suitable sensor element (temperature sensor) which supplies a temperature measurement signal. On the basis of the temperature measured by means of the sensor element, a control unit decides when to eject the ice pieces from the ice-making tray.

In order to accelerate the freezing process, it is known in the case of ice makers to provide a cold air stream which flows along the ice-making tray. The flowing cold air has, for example, a temperature which is significantly below the freezing temperature of water (e.g. minus 20° C. or below) and, owing to the dissipation of heat energy released from the water, effects more rapid freezing of the water.

SUMMARY OF THE INVENTION

The present invention starts from a configuration in which a cold air stream flows along the underside of an ice-making tray of the ice maker, and a sensor element serving as a temperature sensor is arranged on the underside of the ice-making tray. It is an object of the present invention to avoid as far as possible a local impairment of the cooling effect of the cold air stream as a result of the presence of the temperature sensor.

In order to achieve that object there is provided according to the invention a cooling or freezing device comprising an ice-making tray having a plurality of ice-piece-producing cavities distributed over at least two rows of cavities running parallel to one another, a cold air supply system which provides a cold air stream which flows beneath the ice-making tray along the rows of cavities, and a temperature sensor unit which is inserted into a gap formed on the underside of the tray between a pair of adjacent ice-piece-producing cavities, characterised in that the pair of cavities is formed by two ice-piece-producing cavities which, as seen in the direction of flow of the cold air stream, are the last ice-piece-producing cavities of two adjacent rows of cavities.

In the solution according to the invention, the temperature sensor unit is inserted between two adjacent rows of ice-piece-producing cavities. It is thereby arranged between the last ice-piece-producing cavities—as seen in the direction of flow of the cold air stream—of the two rows of cavities in question. Although the temperature sensor unit constitutes an obstacle for the flowing cold air, the solution according to the invention ensures that at most only a very small portion of the outer surface of the ice-making tray on the underside thereof is screened from the cold air stream by the temperature sensor unit. The important factor for the ice production rate of the ice maker is not the time required until the first ice cubes in the ice-making tray have frozen but the required time until the last ice cube has frozen. In regions of the outer surface of the ice-making tray that are shielded from the cold air stream by the temperature sensor unit, a reduced cooling effect of the cold air stream and consequently a longer freezing time of the water are to be expected. If the temperature sensor unit were arranged between two ice-piece-producing cavities that belong to the same row of cavities and are arranged one behind the other in the direction of flow of the cold air channel, a reduced cooling effect on account of the shielding effect of the temperature sensor unit would have to be expected for all the ice-piece-producing cavities situated in the row in question behind the temperature sensor unit in the direction of flow. Likewise, in a case where the temperature sensor unit is arranged between two ice-piece-producing cavities that belong to adjacent rows of cavities but are not the last ice-piece-producing cavities in the two rows of cavities, it would have to be expected that, in both rows, the further cavities situated behind the two ice-piece-producing cavities are shielded to a certain degree by the temperature sensor unit. However, by choosing, according to the invention, two ice-piece-producing cavities that are arranged adjacently transversely to the direction of flow of the cold air stream and that are the last ice-piece-producing cavities, as seen in the direction of flow of the cold air stream, in their respective row of cavities, the regions of the underside of the ice-making tray that are affected by the mentioned shielding effect are reduced to a minimum. It has been shown that, with the measure according to the invention, a significant increase in the ice production rate can be achieved as compared with configurations in which the temperature sensor unit is arranged between a pair of cavities located in a different position in the ice-making tray.

In some embodiments, the temperature sensor unit comprises a temperature sensor element which is in direct contact with the cavity walls of the pair of cavities between which the temperature sensor unit is inserted.

In some embodiments, the cold air supply system comprises a cold air guide trough which is arranged beneath the ice-making tray, which trough delimits a cold air channel for guiding the cold air stream.

In some embodiments, the ice-making tray is longer than it is wide, the cold air stream flowing along the ice-making tray in the longitudinal direction thereof. However, configurations in which the cold air stream flows along the ice-making tray in the transverse direction thereof and the temperature sensor unit is inserted between the last ice-piece-producing cavities of two adjacent rows of cavities extending in the transverse direction of the tray are not ruled out within the scope of the present disclosure.

The invention will be explained further hereinbelow with reference to the accompanying drawings.

DETAILED DESCRIPTION OF THE INVENTION

Figure 1:
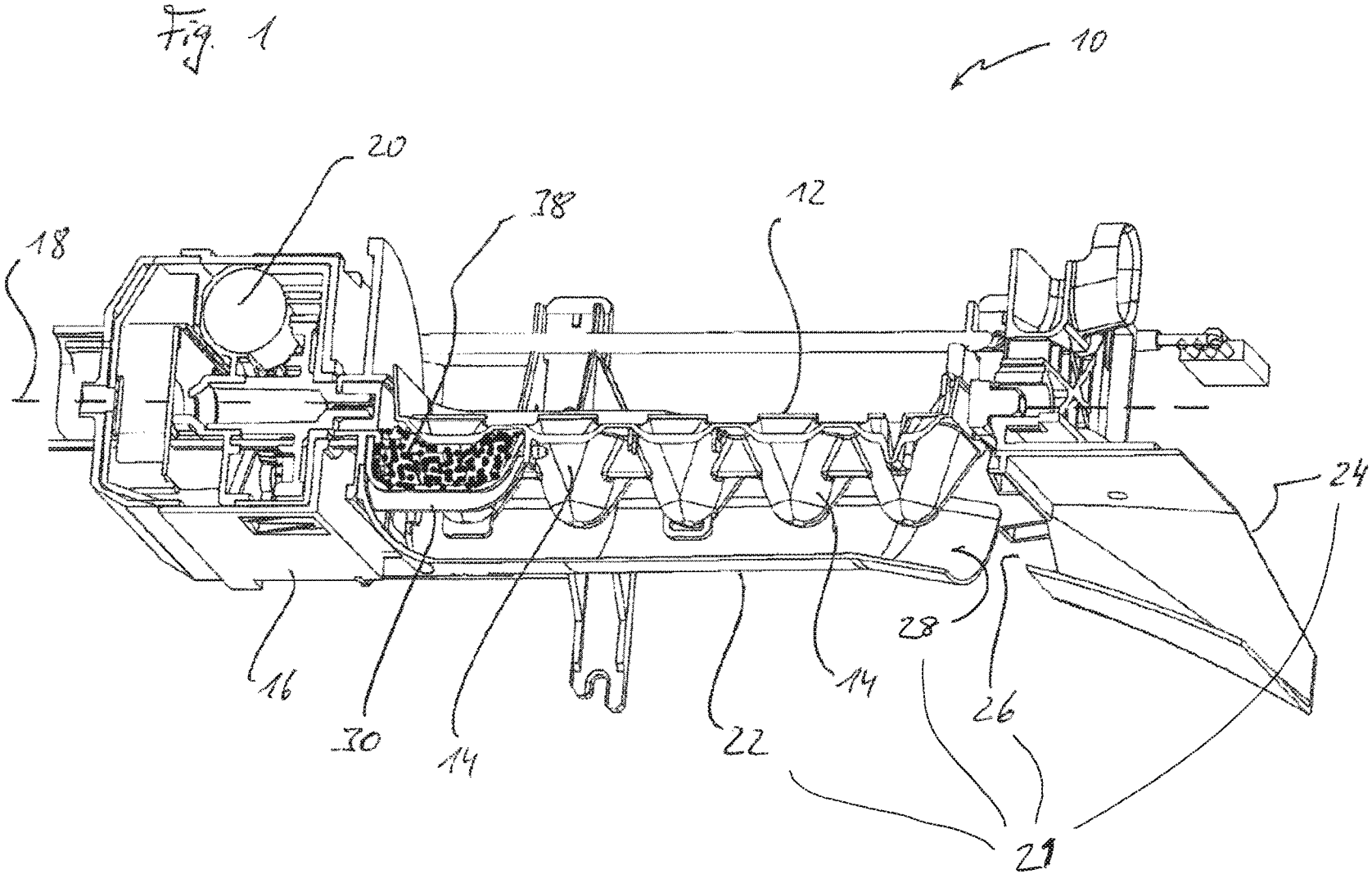
FIG. 1 is a longitudinal section through the middle of an ice-making module according to one embodiment.
Figure 2:
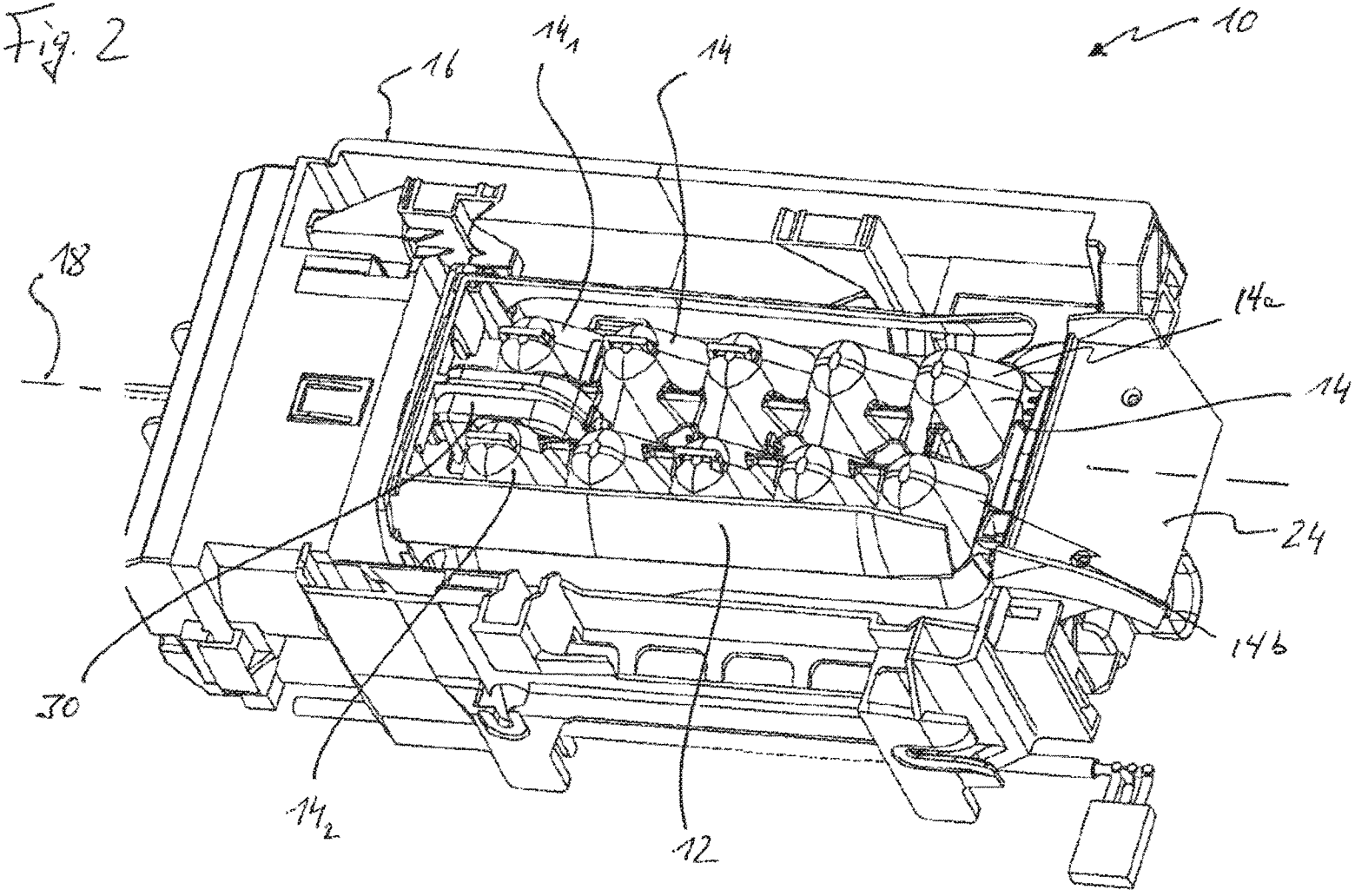
FIG. 2 is a perspective view of the ice-making module of FIG. 1 from obliquely below.
Figure 3:
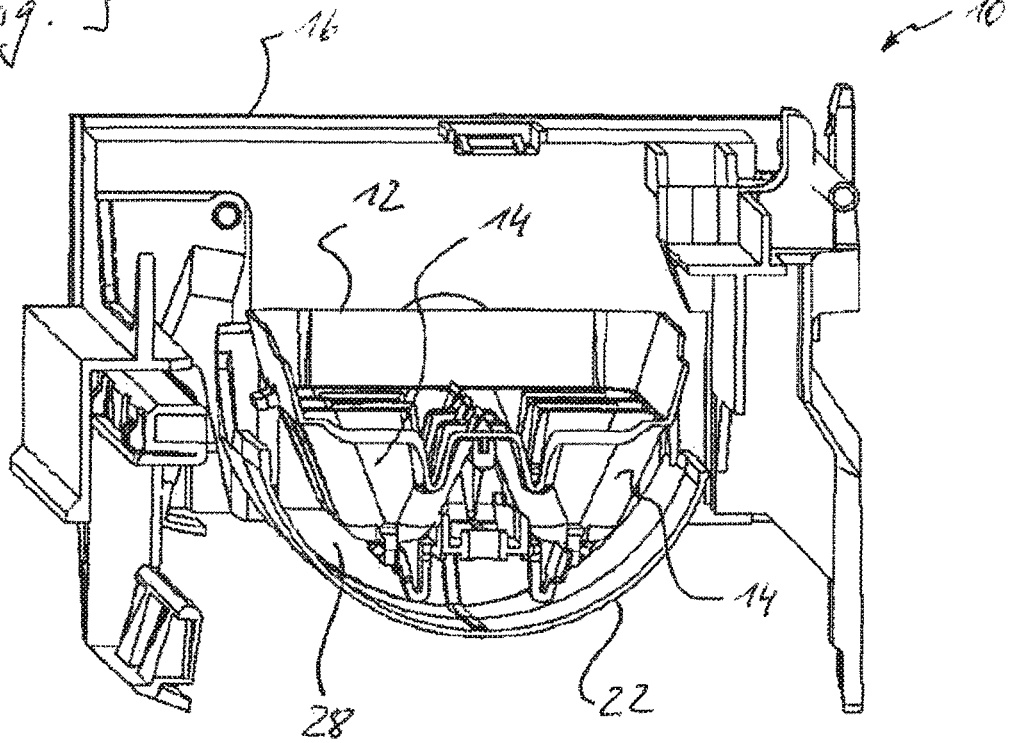
FIG. 3 is a cross-section through the ice-making module of FIG. 1.

Reference will first be made to FIGS. 1 to 3. The ice-making module shown therein is generally designated 10. It is intended to be fitted into a cooling or freezing device for domestic use and serves to produce ice pieces. For this purpose, the ice-making module 10 comprises an ice-making tray 12 having an approximately rectangular tray outline. In the ice-making tray 12 there is formed a plurality of ice-piece-producing cavities 14, each of which serves to produce a single ice piece. The ice-piece-producing cavities 14 are distributed over a plurality (in the example shown, two) of rows 14*a*, 14*b* of cavities 14, which extend in the direction of the longer rectangle sides of the ice-making tray 12 and each contain a plurality (in the example shown, five) of ice-piece-producing cavities 14. The direction of the longer rectangle sides of the ice-making tray 12 is referred to hereinbelow as the longitudinal tray direction, while the direction of the shorter rectangle sides of the ice-making tray 12 is referred to as the transverse tray direction.

The ice-making tray 12 is mounted on a module housing 16, which surrounds it in the manner of a frame, so as to be rotatable about an axis of rotation 18 extending in the longitudinal tray direction. When the ice-making module 10 is in the fitted state in the cooling or freezing device, the axis of rotation 18 is horizontal. By rotation about the axis of rotation 18, the ice-making tray 12 can be rotated between an ice-producing position shown in FIGS. 1 to 3, in which the tray plane of the ice-making tray 12 lies in a horizontal plane, and an ice-ejecting position, which is not shown in greater detail in the figures, in which the ice-making tray 12 has been rotated through a sufficiently large angle of rotation (for example at least 90 degrees or more) relative to the ice-producing position to allow the finished ice pieces to be ejected from the ice-making tray 12. In the example shown, the ice-making module 10 works by the twist-tray principle, that is to say the ice-making tray 12 is twisted on itself in the region of its ice-ejecting position by being rotated further in the region of one of its longitudinal ends while being held in place in the region of its other longitudinal end. The resulting twisting of the ice-making tray 12 causes the ice pieces in the ice-piece-producing cavities 14 to break away from the cavity walls, which facilitates emptying of the ice-making tray 12. When the ice-making module 10 is in the fitted state, there is a receiving container (not shown) of a suitable size beneath the ice-making tray 12, in which the ice pieces that fall out of the ice-making tray 12 are received and collected.

For driving the ice-making tray 12 in rotation, a drive unit 20 is accommodated in the module housing 16, which drive unit comprises a drive motor, for example an electric motor drive motor, which is in driving connection with the ice-making tray 12 via a reduction gear unit, which is not shown in detail.

The ice-making module 10 is fitted in the cooling or freezing device, for example, in such a manner that it is oriented with the axis of rotation 18 parallel to mutually opposite side walls of a wall system delimiting a cooling or freezing compartment of the cooling or freezing device. The cooling or freezing compartment can be closed at the front by a device door of the cooling or freezing apparatus, for example, and is delimited at the back by a rear wall. Parts of a cold air supply system which serves to produce a cold air stream and guide it to the ice-making tray 12 can be arranged behind the rear wall. In particular, at least parts of a guide system which guides the cold air that is produced from a cold air source into the region of the ice-making module 10 can be arranged behind the rear wall.

The cold air supply system 21 comprises as components that are structurally integrated into the ice-making module 10 a cold air guide trough 22 (omitted from FIG. 2 for reasons of clarity) arranged beneath the ice-making tray 12 and also a mouthpiece 24 which forms an outlet opening 26 for the cold air. The mouthpiece 24 is part of the mentioned guide system, which delivers the cold air produced by the cold air source to the ice-making tray 12. The cold air is blown through the mouthpiece 24 into a cold air channel 28 formed between the ice-making tray 12 and the cold air guide trough 22. The cold air guide trough 22 is arranged with its longitudinal trough axis parallel to the longitudinal tray direction of the ice-making tray 12. Accordingly, the cold air channel 28 runs beneath the ice-making tray 12 in the longitudinal tray direction from one longitudinal tray end to the opposite longitudinal tray end. The cold air flowing in the cold air channel 28 flows along the underside of the ice-making tray 12 in contact with the outer surface of the cavity walls of the ice-piece-producing cavities 14. The direct contact of the flowing cold air with the material of the ice-making tray 12 results in efficient heat dissipation from the ice-making tray 12 by the cold air stream, which accelerates the freezing of water introduced into the ice-piece-producing cavities 14 to form ice pieces.

At the downstream end of the cold air channel 28, that is to say at the end of channel remote from the mouthpiece 24, the cold air emerges from the cold air channel 28 into the region surrounding the ice-making module 10. It is of course conceivable in other embodiments purposively to collect the cold air in the region of the downstream end of the channel and to guide it back to a specific location in a defined manner.

Fixed to the underside of the ice-making tray 12 is a temperature sensor unit 30, the measured signal of which is evaluated by a control unit, which is not shown in greater detail, in order to detect when the water introduced into the ice-piece-producing cavities 14 has frozen, so that the ice-making tray 12 can be emptied and refilled with fresh water. As is apparent especially from FIGS. 1 and 2, the temperature sensor unit 30 is inserted into a gap between the two ice-piece-producing cavities that are furthest downstream, which are here designated $\mathbf{14}_1$ and $\mathbf{14}_2$ for the purposes of better identification. The ice-piece-producing cavity $\mathbf{14}_1$ is the last cavity in the direction of flow of the cold air flowing in the cold air channel 28 of a first of the rows of cavities, and the ice-piece-producing cavity $\mathbf{14}_2$ is the last cavity in the direction of flow of the other of the two rows of cavities. This arrangement of the temperature sensor unit 30 results in a very low degree of shielding of ice-piece-producing cavities 14 from the cold air flowing in the cold air channel 28: The cavities situated upstream of the ice-piece-producing cavities $\mathbf{14}_1$, $\mathbf{14}_2$ (in the example shown, a total of four per row of cavities) are largely unaffected by the shielding effect of the temperature sensor unit 30. The two ice-piece-producing cavities $\mathbf{14}_1$, $\mathbf{14}_2$ are themselves shielded directly by the temperature sensor unit 30 at most in the regions of their cavity walls that face one another. In addition, there are no further cavities behind the ice-piece-producing cavities $\mathbf{14}_1$, $14_2$ (that is to say downstream thereof). It has been shown that, with the arrangement of the temperature sensor unit 30 shown, a sufficiently good cooling effect of the cold air stream in the cold air channel 28 can be achieved over all the ice-piece-producing cavities 14.

Figure 4:
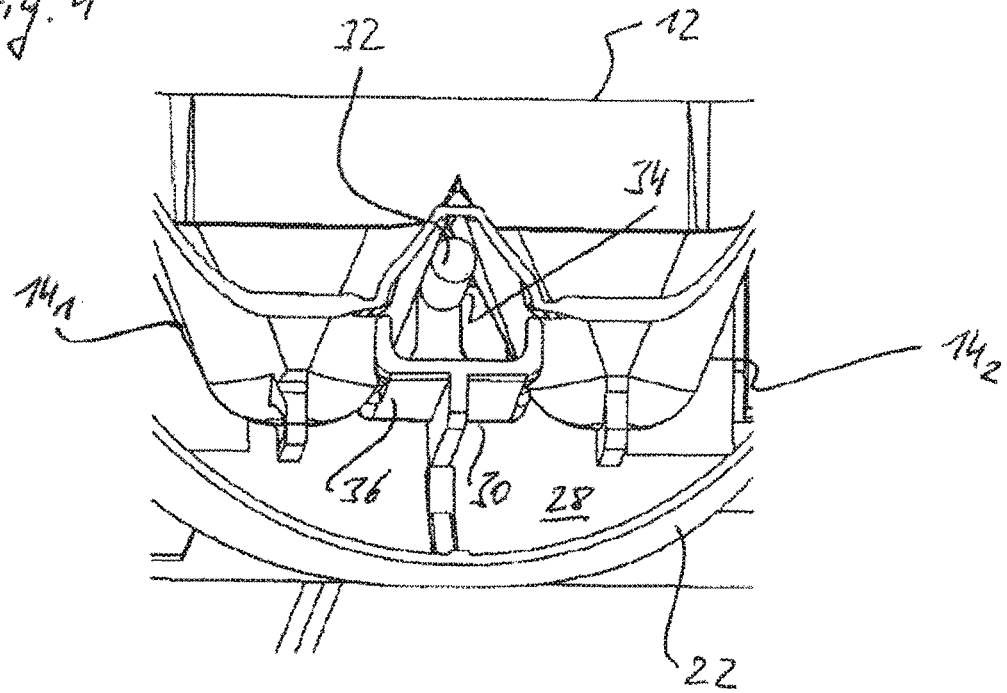
FIG. 4 is an enlarged section of the ice-making module of FIG. 1 in the region of a temperature sensor unit.

Reference will now be made in addition to FIG. 4. The temperature sensor unit 30 comprises a temperature sensor 32 formed, for example, by an electrical resistor element with a negative temperature coefficient (NTC element), which in the example shown has a rod-like main sensor portion 34 which is in direct contact with the cavity walls of the two ice-piece-producing cavities $14_1$, $14_2$. The temperature detected by the temperature sensor 32 is a measure of the temperature of the water in the two ice-piece-producing cavities $14_1$, $14_2$. The temperature sensor 32 is accommodated in a sensor housing 36, which is fixed to the underside of the ice-making tray 12 by, for example, a snap connection or another type of fixing. The remaining space inside the sensor housing 36 is filled with a thermally insulating material 38, which is indicated schematically in FIG. 1 by a plurality of circles coloured black and is omitted from FIG. 4 for reasons of clarity. The insulating material 38 insulates the temperature sensor 32 thermally with respect to the cold of the cold air flowing in the cold air channel 38, which has a temperature of, for example, minus 20° C. or below. As can readily be seen in FIG. 4 especially, the temperature sensor unit 30—when seen in a tray cross-section—fills the gap between the two ice-piece-producing cavities $14_1$, $14_2$ substantially completely. When seen in cross-section, that gap has approximately the outline of a triangle. The sensor housing 36 extends substantially into the region of the cavity bottom of the ice-piece-producing cavities $14_1$, $14_2$, but in other embodiments it may of course end before the cavity bottom of the two cavities or even project beyond the cavity bottom of the two cavities.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A cooling or freezing device comprising:

an ice-making tray having a plurality of ice-piece-producing cavities distributed over at least two rows of cavities running parallel to one another, the ice-making tray having a plurality of cavity walls to delimit each of the plurality of ice-piece-producing cavities;

a cold air supply system which provides a cold air stream which flows beneath the ice-making tray along the rows of cavities; and a temperature sensor unit which is inserted into a gap formed on the underside of the tray between a pair of adjacent ice-piece-producing cavities, wherein the pair of cavities is formed by two ice-piece-producing cavities which, as seen in the direction of flow of the cold air stream, are the last ice-piece-producing cavities of two adjacent rows of cavities;

wherein the temperature sensor unit comprises a temperature sensor and a sensor housing, the sensor housing being fixed to the underside of the ice-making tray, the temperature sensor being accommodated in the sensor housing and having a rod-like main sensor portion which is in direct contact with a cavity wall of each of the pair of adjacent ice-piece-producing cavities.

2. The cooling or freezing device according to claim 1, wherein the cold air supply system comprises a cold air guide trough arranged beneath the ice-making tray, which trough delimits a cold air channel for guiding the cold air stream.

3. The cooling or freezing device according to claim 1, wherein the ice-making tray is longer than it is wide, and the cold air stream flows along the ice-making tray in the longitudinal direction thereof.

* * * * *